US007828944B2

(12) United States Patent
Nagashima et al.

(10) Patent No.: US 7,828,944 B2
(45) Date of Patent: Nov. 9, 2010

(54) ELECTROPLATING APPARATUS

(75) Inventors: Atsushi Nagashima, Funabashi (JP); Hiroshi Oshibe, Kodaira (JP)

(73) Assignee: Tosetz Inc., Saitama-Ken (JP)

( * ) Notice: Subject to any disclaimer, the term of this patent is extended or adjusted under 35 U.S.C. 154(b) by 757 days.

(21) Appl. No.: 11/779,362

(22) Filed: Jul. 18, 2007

(65) Prior Publication Data

US 2008/0017503 A1 Jan. 24, 2008

(30) Foreign Application Priority Data

Jul. 18, 2006 (JP) ..... 2006-195686

(51) Int. Cl.
*B23H 7/26* (2006.01)

(52) U.S. Cl. ..... 204/297.03; 204/198; 204/297.01

(58) Field of Classification Search ..... 204/198, 204/297.01, 297.03
See application file for complete search history.

(56) References Cited

U.S. PATENT DOCUMENTS 4,428,815 A * 1/1984 Powell et al. ..... 204/297.03
6,416,647 B1 * 7/2002 Dordi et al. ..... 205/137

FOREIGN PATENT DOCUMENTS

JP 2006328470 12/2006

* cited by examiner

*Primary Examiner*—Luan V Van
(74) *Attorney, Agent, or Firm*—Price, Heneveld, Cooper, DeWitt & Litton, LLP

(57) ABSTRACT

An electroplating apparatus includes: a wafer holder that is detachable from an engaging hole of a cathode holder and capable of moving in a up and down direction; a spring contact type cathode electrode that is fixed to an electrode housing recess on a top surface of the wafer holder and presses against a backside of a wafer placed on the wafer holder; and a suction pad that is fixed to a pad housing recess on a top surface of the wafer holder and suctions the backside of the wafer placed on the wafer holder.

8 Claims, 4 Drawing Sheets

ELECTROPLATING APPARATUS

FIELD OF THE INVENTION

The invention relates to an electroplating apparatus used for plating substrates for electronic components, wafers for ICs and wafers for thin-film magnetic heads.

BACKGROUND OF THE INVENTION

A thin plating film attached to a plating surface (referred to as a front surface) of a wafer is formed by use of an electroplating apparatus. In the electroplating apparatus, a conductive base film is disposed on a front side on which a plating film is being formed and, with the base film as a cathode, a current is flowed in a plating solution to precipitate a plating film on the base film.

As an existing electroplating apparatus, an apparatus where the plating is carried out with a front side of a wafer turned downward (referred to as a bottom surface plating method) and an apparatus where the plating is carried out with the front side turned upward (referred to as a top surface plating method) are in use.

In the electroplating apparatus for bottom surface plating method, an anode electrode is disposed at a bottom portion of a plating bath, on an upper side thereof a wafer holder is disposed movable up and down, on the wafer holder a wafer is placed with a front side turned downward, after that a cathode holder is inserted in the wafer holder, a spring contact type cathode electrode is brought into contact with a back side of the wafer under pressure and the wafer is energized.

In the bottom surface plating method, since a wafer and a wafer holder are manually set to carry out the plating with a front side turned downward, the operating efficiency is not good. In this connection, in order to improve the operating efficiency, an automation apparatus is considered.

However, the process of setting a cathode electrode and a wafer can be automated only in a very complicated manner. In a Permalloy plating apparatus where the plating is applied with a magnetic field applied to give the directionality, the automation in the bottom surface plating method is difficult and has not yet been put into practical use.

Furthermore, in the plating apparatus for the top surface plating method, an anode electrode is disposed on an upper portion of a plating bath, at a bottom portion thereof a cathode holder having an engaging hole is disposed, a wafer holder is disposed detachably with the engaging hole and a wafer is placed on the wafer holder with a front side thereof turned upward. After that, an electrode housing recess of the wafer holder, in which a spring contact type cathode electrode is accommodated is evacuated to hold the wafer, the electrode is brought into contact with a backside of the wafer and the wafer holder is lifted and inserted into the engaging hole to closely seal the bottom portion.

The above-described top surface plating apparatus has problems outlined below.

That is, in order to automate an electroplating apparatus, when a wafer is placed on a wafer holder, the wafer has to be assuredly held and a cathode electrode has to be brought into contact with a backside of the wafer at a predetermined contact pressure to enable an assured energization.

However, a tip end of the cathode electrode, in consideration of a bending portion, is disposed a little above a top surface of the wafer holder and the cathode electrode applies pressure in a direction in which the wafer is detached from the wafer holder; accordingly, the wafer cannot be brought into contact with a top surface of the wafer holder. As a result, when a vacuum line is operated, the electrode recess cannot be evacuated, the wafer holder cannot assuredly hold the wafer and desired contact pressure of the cathode electrode can be obtained only with great difficulty.

In order to overcome the above-mentioned problems, what is mentioned below can be considered.

In an electrode housing recess of a wafer holder, a lift unit is disposed to displace a cathode electrode. When a wafer is placed on the wafer holder, the cathode electrode is moved downward so that a tip end thereof may not protrude from a top surface of the wafer holder, after the wafer holder on which the wafer has been placed is inserted in an engaging hole, the lift unit is driven to lift the cathode electrode to bring the tip end thereof into contact under pressure with a backside of the wafer.

However, according to the method, the lift apparatus has to be disposed inside of a small wafer holder; accordingly, the apparatus becomes very complicated and is difficult to put into practical use.

SUMMARY OF THE INVENTION

The present invention, in view of the above-mentioned situations, intends to assuredly hold a wafer to a wafer holder and to enable it to sufficiently energize.

An aspect of the present invention includes providing an electroplating apparatus including: a plating bath in which a plating solution is accommodated; a cathode holder having an engaging hole disposed penetrating through a bottom portion of the plating bath; a wafer hold disposed at an upper end of the engaging hole; a wafer holder that is detachable from the engaging hole from a bottom surface side of the cathode holder and can move in an up and down direction; an electrode housing recess disposed on a top surface of the wafer holder; a spring contact type cathode electrode that is fixed to the electrode housing recess and presses against a backside of a wafer placed on the wafer holder; a pad housing recess disposed on a top surface of the wafer holder; and a suction pad that is fixed to the pad housing recess and suctions the backside of the wafer placed on the wafer holder.

The spring contact type cathode electrode of an aspect of the invention includes an annular fixing portion and a plurality of upward slopes. The plurality of upward slopes becomes gradually slender as they go from a base end side toward a free end side. The wafer hold can comprise an inner periphery portion of an annular cathode auxiliary electrode.

Between the wafer hold and a front side of the wafer, a sealing means is disposed. The sealing means is a seal rubber disposed on a bottom surface of the wafer hold. A tip end of the spring contact type cathode electrode and an upper end of the suction pad protrude from a top surface of the wafer holder and a protrusion amount of the electrode is smaller than a protrusion amount of the suction pad. A protrusion amount of the spring contact type cathode electrode is in the range of 0.1 to 1 mm and that of the suction pad is in the range of 1 to 2 mm.

Since an aspect of the present invention is constituted as mentioned above, a wafer placed on a wafer holder is suctioned at a backside thereof by a suction pad and held and fixed to the wafer holder. Furthermore, when the wafer holder is inserted in an engaging hole and the wafer is brought into contact with a wafer hold, a cathode electrode is pressed against a backside of the wafer and bent to sufficiently come into contact with it; and therefore, the energization can be assuredly secured.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
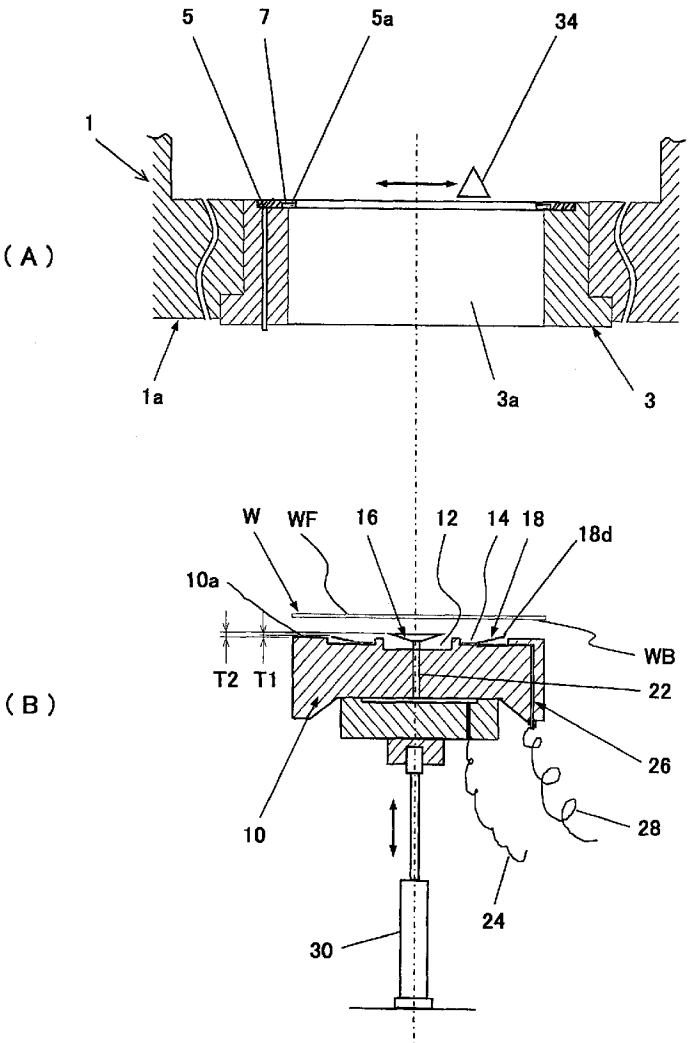
FIGS. 1(A) and 1(B) are diagrams showing an embodiment of the present invention, FIG. 1(A) being a longitudinal sectional view of a bottom portion of a plating bath, FIG. 1(B) being a longitudinal sectional view of a wafer holder.

An embodiment of the present invention will be described with reference to FIGS. 1 through 5.

At a bottom portion 1*a* of a plating bath 1, a cathode holder 3 having an engaging hole 3*a* is disposed. At an upper end of the engaging hole 3*a*, an annular cathode auxiliary electrode 5 is disposed. The electrode 5 inhibits a current of an outer peripheral portion of a wafer W from concentrating; and therefore, a film thickness can be uniformized. An inner peripheral portion 5*a* of the auxiliary electrode 5 projects inside of the engaging hole 3*a* and works as a wafer hold when a wafer holder 10 is inserted in the engaging hole 3*a*. On a bottom surface of the inner peripheral portion 5*a*, a sealing means is disposed, as the sealing means, for instance, a seal rubber 7 being adopted. Other sealing means are contemplated.

Below the cathode holder 3, a wafer holder 10 is disposed. At a center portion of a top surface 10*a* of the wafer holder 10, a circular pad housing recess 12 is disposed and outside thereof an annular electrode housing recess 14 is disposed.

Figure 3:
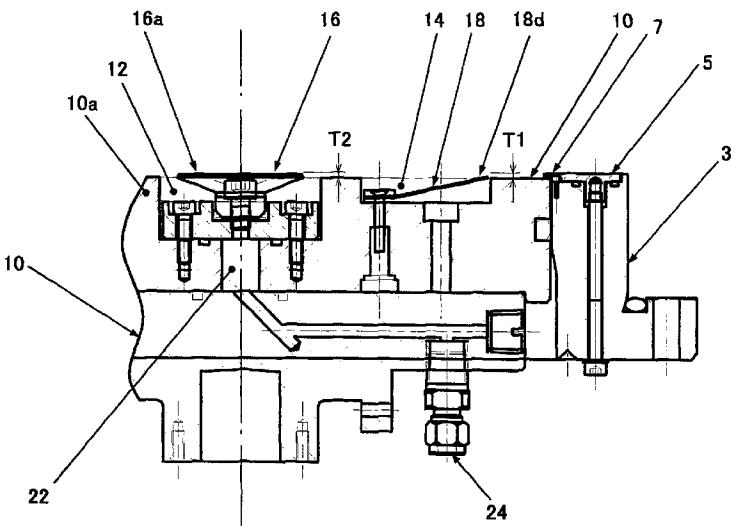
FIG. 3 is an enlarged diagram of an essential portion of a wafer holder.

To the pad housing recess 12, a suction pad, for instance, a rubber vacuum pad, 16 is fixed. The suction pad 16 is formed in an inverse conical shape and an upper end surface 16*a* thereof slightly protrudes from the top surface 10*a* of the wafer holder 10 (FIGS. 1 and 3). A protrusion amount T2 is selected in a range where a backside WB of the wafer W can be held in close contact with a top surface 10*a* of the wafer holder 10. For instance, as the protrusion amount T2, 1 to 2 mm is selected.

Figure 4:
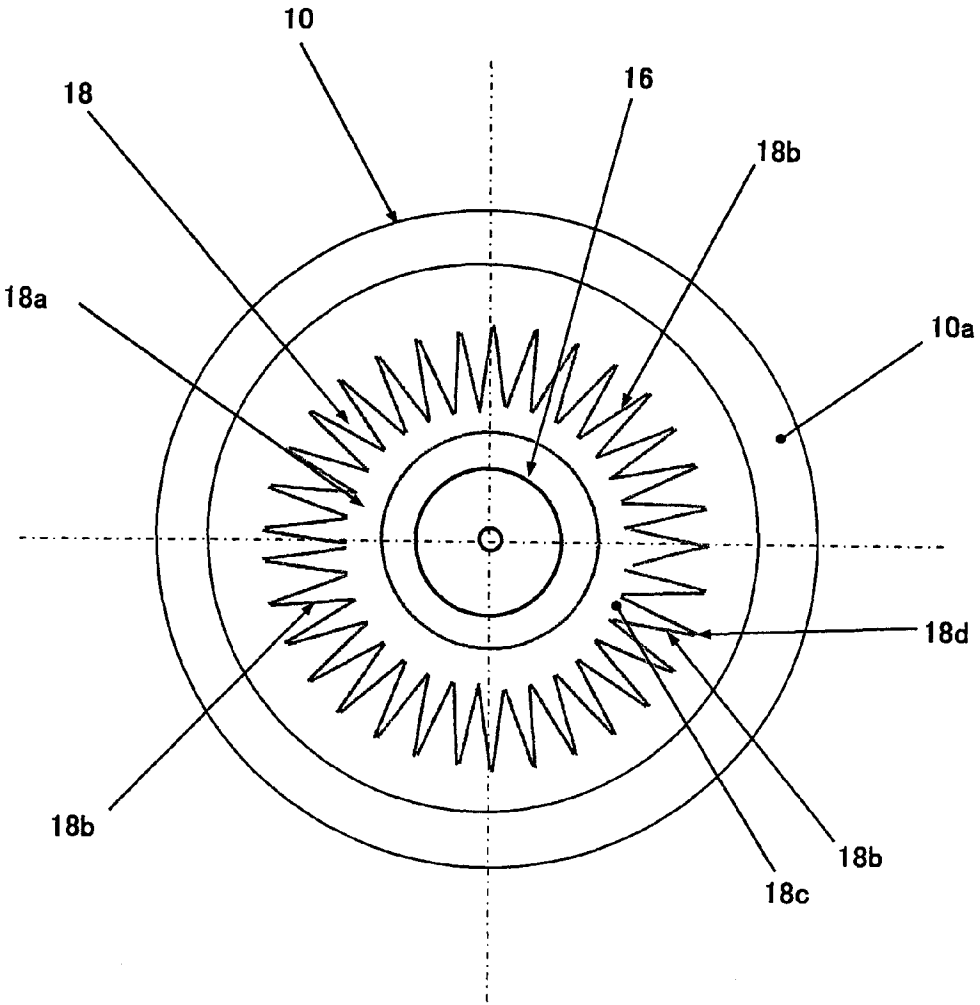
FIG. 4 is a plan view of a wafer holder.
Figure 5:
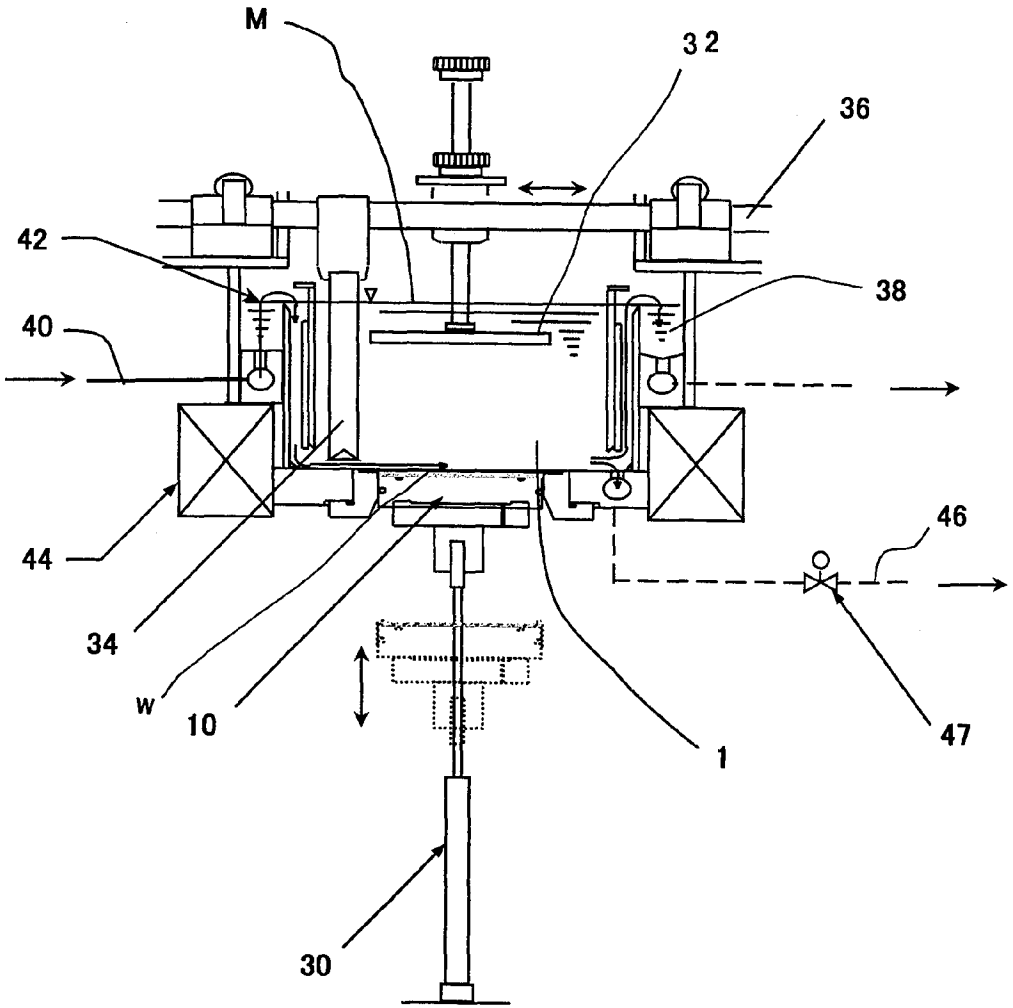
FIG. 5 is a longitudinal sectional view of a plating apparatus.

In the electrode housing recess 14, a spring contact type cathode electrode 18 is fixed. The electrode 18, as shown in FIG. 4, includes an annular fixing portion 18*a* and upward slope portions 18*b*. A plurality of, for instance, thirty-four slope portions 18*b* is formed in a circumferential direction at an identical interval along an outer periphery of the fixing portion 18*a*.

Each of the slope portions 18*b* gradually becomes more slender as it goes from a base end 18*c* side toward a tip end 18*d* side and inclines upward. The tip end 18*d* of the upward slope portion 18*b* protrudes from a top surface 10*a* of the wafer holder 10. A protrusion amount T1 thereof is selected in a range where the tip end 18*d*, when coming into contact with a backside WB of the wafer W, bends and can obtain a predetermined contact pressure. For instance, as the protrusion amount T1 thereof, a value smaller than the protrusion amount T2 of the suction pad 16, for instance, T1=0.1 to 1 mm is selected.

When the cathode electrode 18 is formed like a starfish, a cathode electrode 18 having a great bending flexibility and toughness can be obtained. A shape, slope angle and number of the upward slopes 18*b* are appropriately selected as necessary.

The wafer holder 10 is provided with a suction path 22 communicated with the suction pad 16 and the suction path 22 is connected to a vacuum line 24. Furthermore, the wafer holder 10 is provided with a cathode wafer electrode 26 and the cathode wafer electrode 26 is connected to a cathode wafer power supply 28. To the wafer holder 10, a means that can move in an up and down direction, for instance, a lift cylinder 30, is connected. Other means are contemplated.

In the drawings, reference numeral 31 denotes a cathode auxiliary electrode power supply; 32, an anode (plus electrode) disposed in a plating bath 1; 34, a sliding paddle in the plating bath 1; 36, a paddle sliding arm; 38, an overflow portion that reserves an overflowed plating solution and returns it to a circulating tank (not shown in the drawings); 40, a plating supply tube for supplying the plating solution from the circulating tank to a plating solution circulation supply 42; 44, a magnet; 46, a return to the circulating tank; and 47, an automatic valve.

Next, an operation of the embodiment will be described.

As shown in FIG. 1, when an object to be plated, for instance, a wafer W for ICs, is placed on a wafer holder 10 with a backside WB thereof turned downward, the wafer W comes into contact with an upper end surface 16*a* of a suction pad 16. The upper end surface 16*a* of the suction pad 16 is separated by T2 from a top surface 10*a* of the wafer holder 10; accordingly, the wafer W does not come into close contact with the top surface 10*a* of the wafer holder 10.

At this time, a protrusion amount T1 of a tip end 18*d* of a cathode electrode 18 is smaller than the top end surface 16*a* of the pad 16; accordingly, the cathode electrode 18 does not come into contact with the wafer W.

When a suction driver (not shown) is started operating, evacuation is carried out through a vacuum line 24 and a suction path 22, the suction pad 16 suctions a backside WB of the wafer W; accordingly, the wafer W is assuredly fixed and held.

Figure 2:
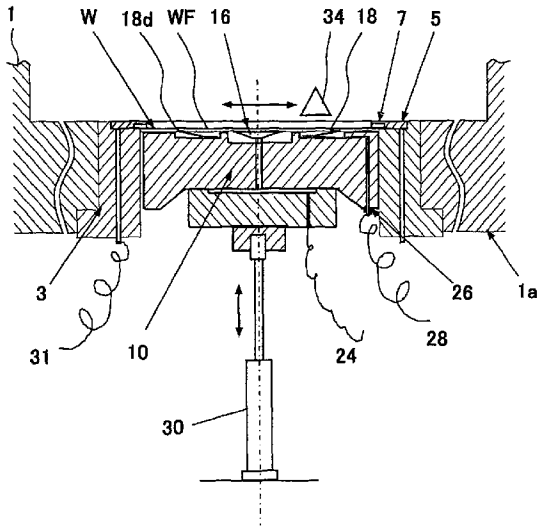
FIG. 2 is a longitudinal sectional view showing a state where a wafer holder is inserted in a cathode holder.

In this state, a lift cylinder 30 is driven. As shown in FIG. 2, a wafer holder 10 is inserted into an engaging hole 3*a* of a cathode holder 3 and a front side WF of the wafer W is pushed against a seal rubber 7.

Thereby, the suction pad 16 is deformed and an upper end surface 16*a* thereof becomes level with the top surface 10*a* of the wafer holder 10. The tip ends 18*d* of the cathode electrode 18 bends and descends to a position of the top surface 10*a* of the wafer holder 10 to press the backside WB of the wafer W. Between the wafer W and the cathode auxiliary electrode 5, a seal rubber 7 is used to seal and in this state a bottom portion 1*a* of the plating bath 1 is completely sealed.

In the sealed state, a plating solution M is filled in the plating bath 1, and the respective electrodes 5, 18, 26 and 32 are energized to plate the front side WF of the wafer W.

Upon completion of the plating, the plating solution M in the plating tank 1 is returned to the circulating tank to empty the inside of the plating tank 1, followed by driving the lift cylinder 30 to lower the wafer holder 10 to extract from the engaging hole 3*a* of the cathode holder 3.

When the lift cylinder 30 reaches an initial position, the suction driver is stopped driving to unleash the suction of the suction pad 16 and a plated wafer W is removed from the wafer holder 10 and stored in a predetermined place.

Although an attach and remove operation of the wafer W to and from the wafer holder 10 is automatically carried out with a robot, it goes without saying that the operation can be manually carried out without using a robot.

An embodiment of the present invention is not restricted to the above-mentioned one. For instance, the following may be adopted.

(1) In the foregoing embodiment, as an object to be plated, a wafer for ICs is used. However, an object to be plated in the present invention includes, in addition to the wafer for ICs, a substrate for electronic components and a wafer for thin-film magnetic heads. The "wafer" referred to here includes all of the above-mentioned objects to be plated.

(2) As the wafer hold, in place of an inner periphery portion of the cathode auxiliary electrode, a hold click may be used. A plurality of the hold clicks are disposed at circumferentially spaced intervals, for example, protruding from and along an outer periphery portion of the engaging hole.

The above description is considered that of the preferred embodiments only. Modification of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. An electroplating apparatus, comprising:

a plating bath in which a plating solution is accommodated;

a cathode holder having an engaging hole disposed penetrating through a bottom portion of the plating bath;

a wafer hold disposed at an upper end of the engaging hole;

a wafer holder that is detachable from the engaging hole from a lower surface side of the cathode holder and capable of moving in an up and down direction;

an electrode housing recess disposed on a top surface of the wafer holder;

a spring contact type cathode electrode that is fixed to the electrode housing recess and presses against a backside of a wafer placed on the wafer holder;

a pad housing recess disposed on a top surface of the wafer holder; and a suction pad that is fixed to the pad housing recess and suctions the backside of the wafer placed on the wafer holder to bring the wafer into close contact with a top surface of the wafer holder.

2. The electroplating apparatus of claim 1, wherein the spring contact type cathode electrode includes an annular fixing portion and a plurality of upward slopes.

3. The electroplating apparatus of claim 2, wherein the plurality of upward slopes become gradually more slender as they go from a base end side toward a free end side.

4. The electroplating apparatus of any one of claim 1, wherein the wafer hold is an inner periphery portion of an annular cathode auxiliary electrode.

5. The electroplating apparatus of claim 1, wherein between the wafer hold and a front side of the wafer, a seal is disposed.

6. The electroplating apparatus of claim 5, wherein the seal is a seal rubber disposed on a lower surface of an inner periphery of the cathode electrode.

7. The electroplating apparatus of claim 1, wherein a tip end of the spring contact type cathode electrode and an upper end of the suction pad protrude from a top surface of the wafer holder and a protrusion amount of the cathode electrode is smaller than a protrusion amount of the suction pad.

8. The electroplating apparatus of claim 7, wherein a protrusion amount of the spring contact type cathode electrode is in the range of 0.1 to 1 mm and that of the suction pad is in the range of 1 to 2 mm.

* * * * *